US010458128B2

(12) United States Patent
Cook et al.

(10) Patent No.: US 10,458,128 B2
(45) Date of Patent: Oct. 29, 2019

(54) LOOSEFILL INSULATION BLOWING MACHINE WITH A DISTRIBUTION AIRSTREAM HAVING A VARIABLE FLOW RATE

(71) Applicant: Owens Corning Intellectual Capital, LLC, Toledo, OH (US)

(72) Inventors: David M. Cook, Granville, OH (US); Brandon Robinson, Sylvania, OH (US); Christopher M. Relyea, Columbus, OH (US); James W. Rinne, Granville, OH (US); Brent J. Carey, Reynoldsburg, OH (US)

(73) Assignee: Owens Corning Intellecutal Capital, LLC, Toledo, OH (US)

( * ) Notice: Subject to any disclaimer, the term of this patent is extended or adjusted under 35 U.S.C. 154(b) by 937 days.

(21) Appl. No.: 14/878,233

(22) Filed: Oct. 8, 2015

(65) Prior Publication Data

US 2017/0101790 A1 Apr. 13, 2017

(51) Int. Cl.
*E04F 21/08* (2006.01)
*B02C 18/22* (2006.01)

(52) U.S. Cl.
CPC ..... *E04F 21/085* (2013.01); *B02C 18/2216* (2013.01)

(58) Field of Classification Search
CPC . B02C 18/22; B02C 18/2208; B02C 18/2216; B02C 18/2225; B02C 18/2291; B02C 25/00; E04F 21/085
USPC ..... 241/18
See application file for complete search history.

(56) References Cited

U.S. PATENT DOCUMENTS

| | | | | |
|---|---|---|---|---|
| 3,135,561 A | | 6/1964 | Kempthorne | |
| 3,995,775 A | * | 12/1976 | Birkmeier | E04F 21/085 406/96 |
| 4,337,902 A | * | 7/1982 | Markham | B02C 13/288 241/188.1 |
| 4,537,333 A | | 8/1985 | Bjerregaard | |
| 4,661,024 A | | 4/1987 | Häfner | |
| 4,705,936 A | * | 11/1987 | Fowler | F22B 1/30 122/379 |

(Continued)

*Primary Examiner* — Shelley M Self
*Assistant Examiner* — Smith Oberto Bapthelus
(74) *Attorney, Agent, or Firm* — MacMillan, Sobanski & Todd, LLC

(57) ABSTRACT

A machine for distributing insulation material from a package of compressed insulation material has a chute having an inlet end and an outlet end, the inlet end configured to receive compressed insulation material. A lower unit has a shredding chamber configured to receive the insulation material from the outlet end of the chute. The shredding chamber includes shredders and at least one agitator configured to condition the insulation material, thereby forming conditioned insulation material. A discharge mechanism receives the conditioned insulation material exiting the shredding chamber and distributes the conditioned insulation material into a distribution airstream. A blower is configured to provide the distribution airstream flowing through the discharge mechanism, the blower driven by a blower motor. A flow rate of the distribution airstream can be varied by control the rotational speed of the blower motor, thereby varying the density, coverage and thermal insulative value of the distributed insulation material.

16 Claims, 5 Drawing Sheets

(56) References Cited

U.S. PATENT DOCUMENTS 5,511,730 A 4/1996 Miller et al.
5,590,984 A * 1/1997 Assarsson ..... E04F 21/12 222/181.1
5,639,033 A 6/1997 Miller et al.
6,092,747 A * 7/2000 Gerber ..... B05B 7/145 241/186.2
6,191,930 B1 * 2/2001 Ramchandani ..... A45D 20/12 361/213
6,503,026 B1 1/2003 Mitchell
6,964,543 B2 11/2005 Gerber
7,063,519 B2 * 6/2006 Agrawal ..... F04D 29/057 417/365
7,125,204 B2 * 10/2006 Wysong ..... B60P 1/60 406/38
7,144,203 B2 12/2006 Gerber
7,731,115 B2 * 6/2010 Johnson ..... E04F 21/085 241/101.8
7,762,484 B2 7/2010 Johnson et al.
7,967,227 B2 * 6/2011 Johnson ..... E04F 21/085 241/101.8
8,087,601 B2 * 1/2012 Johnson ..... E04F 21/085 241/236
8,141,222 B2 * 3/2012 Evans ..... B23P 11/00 29/428
8,245,960 B2 * 8/2012 Johnson ..... E04F 21/085 241/101.8
8,328,123 B2 * 12/2012 Evans ..... E04F 21/085 241/18
8,793,952 B2 * 8/2014 Olang ..... E04B 1/7604 428/309.9
8,794,554 B2 * 8/2014 Evans ..... E04F 21/085 241/224
9,004,382 B2 * 4/2015 Johnson ..... E04F 21/085 241/236
9,144,358 B2 * 9/2015 Smith ..... A47L 9/102
9,145,674 B2 * 9/2015 Hahn ..... E04B 1/803
9,500,117 B2 * 11/2016 Sullivan ..... F01P 5/02
2006/0162119 A1 * 7/2006 Smith ..... A47L 9/0416 15/388
2006/0288516 A1 * 12/2006 Sawalski ..... A47L 5/26 15/320
2007/0054639 A1 * 3/2007 Bauman ..... H04B 1/207 455/222
2008/0087751 A1 * 4/2008 Johnson ..... E04F 21/085 241/60
2008/0087752 A1 * 4/2008 Johnson ..... E04F 21/085 241/80
2008/0089748 A1 * 4/2008 Johnson ..... E04F 21/085 406/136
2008/0107523 A1 * 5/2008 Chen ..... F04D 29/282 415/206
2008/0173737 A1 * 7/2008 Evans ..... E04F 21/085 239/698
2008/0201897 A1 * 8/2008 Nakai ..... A47L 9/0477 15/339
2009/0257833 A1 * 10/2009 Johnson ..... E04F 21/085 406/181
2010/0107550 A1 * 5/2010 Toas ..... E04B 1/74 52/742.12
2010/0147983 A1 * 6/2010 Evans ..... B02C 23/30 241/60
2010/0219273 A1 * 9/2010 Johnson ..... E04F 21/085 241/101.71
2010/0219274 A1 * 9/2010 Johnson ..... E04F 21/085 241/101.71
2010/0230522 A1 * 9/2010 Johnson ..... E04F 21/085 241/60
2010/0271560 A1 * 10/2010 Higuchi ..... H04N 21/43615 348/738
2010/0297424 A1 * 11/2010 Romes ..... B29C 44/12 428/307.7
2010/0314474 A1 * 12/2010 Evans ..... B65G 53/4633 241/60
2011/0138724 A1 * 6/2011 Olang ..... E04B 1/7604 52/309.4
2011/0214278 A1 * 9/2011 Evans ..... B23P 11/00 29/434
2011/0226881 A1 * 9/2011 Johnson ..... E04F 21/085 241/282.1
2012/0032012 A1 * 2/2012 Johnson ..... E04F 21/085 241/282.1
2012/0074248 A1 * 3/2012 Evans ..... E04F 21/085 241/15
2014/0140861 A1 5/2014 Pellenc
2014/0261259 A1 * 9/2014 Sullivan ..... F01P 5/02 123/41.65
2015/0143774 A1 * 5/2015 Downey ..... E04B 1/7604 52/741.4
2016/0296940 A1 * 10/2016 Cook ..... B02C 18/2216
2016/0296941 A1 * 10/2016 Cook ..... B02C 18/142
2016/0298341 A1 * 10/2016 Cook ..... E04F 21/085
2016/0303576 A1 * 10/2016 Cook ..... B02C 18/2216
2016/0305133 A1 * 10/2016 Cook ..... E04F 21/085
2016/0305134 A1 * 10/2016 Cook ..... E04F 21/085
2016/0354788 A1 * 12/2016 Cook ..... B02C 18/2291
2017/0073981 A1 * 3/2017 Cook ..... E04F 21/085
2017/0073982 A1 * 3/2017 Cook ..... E04F 21/085
2017/0101790 A1 * 4/2017 Cook ..... B02C 18/2216
2017/0145701 A1 * 5/2017 Cook ..... B62B 1/12

* cited by examiner

LOOSEFILL INSULATION BLOWING MACHINE WITH A DISTRIBUTION AIRSTREAM HAVING A VARIABLE FLOW RATE

BACKGROUND

When insulating buildings and installations, a frequently used insulation product is loosefill insulation material. In contrast to the unitary or monolithic structure of insulation materials formed as batts or blankets, loosefill insulation material is a multiplicity of discrete, individual tufts, cubes, flakes or nodules. Loosefill insulation material is usually applied within buildings and installations by blowing the loosefill insulation material into an insulation cavity, such as a wall cavity or an attic of a building. Typically loosefill insulation material is made of glass fibers although other mineral fibers, organic fibers, and cellulose fibers can be used.

Loosefill insulation material, also referred to as blowing wool, is typically compressed in packages for transport from an insulation manufacturing site to a building that is to be insulated. Typically the packages include compressed loosefill insulation material encapsulated in a bag. The bags can be made of polypropylene or other suitable material. During the packaging of the loosefill insulation material, it is placed under compression for storage and transportation efficiencies. Typically, the loosefill insulation material is packaged with a compression ratio of at least about 10:1.

The distribution of loosefill insulation material into an insulation cavity typically uses an insulation blowing machine that conditions the loosefill insulation material to a desired density and entrains the conditioned loosefill insulation material within an airstream through a distribution hose.

It would be advantageous if insulation blowing machines could be improved to make them more efficient.

SUMMARY

The above objects as well as other objects not specifically enumerated are achieved by a machine for distributing loosefill insulation material from a package of compressed loosefill insulation material. The machine includes a chute having an inlet end and an outlet end, the inlet end configured to receive compressed loosefill insulation material. A lower unit has a shredding chamber configured to receive the compressed loosefill insulation material from the outlet end of the chute. The shredding chamber includes a plurality of shredders and at least one agitator configured to shred, pick apart and condition the loosefill insulation material, thereby forming conditioned loosefill insulation material. A discharge mechanism is mounted to receive the conditioned loosefill insulation material exiting the shredding chamber, the discharge mechanism configured to distribute the conditioned loosefill insulation material into a distribution airstream. A blower is configured to provide the distribution airstream flowing through the discharge mechanism, the blower driven by a blower motor. A flow rate of the distribution airstream can be varied by control the rotational speed of the blower motor, thereby varying the density, coverage and thermal insulative value of the distributed loosefill insulation material.

According to this invention there is also provided a method of operating a machine for distributing loosefill insulation material from a package of compressed loosefill insulation material. The method includes the steps of loading compressed loosefill insulation material into a chute, guiding the compressed loosefill insulation material from the chute into a lower unit, the lower unit having a shredding chamber, the shredding chamber including a plurality of shredders configured to shred, pick apart and condition the loosefill insulation material, the plurality of shredders driven by one or more motors, the lower unit also having a discharge mechanism mounted to receive the conditioned loosefill insulation material exiting the shredding chamber, the discharge mechanism configured to distribute the conditioned loosefill insulation material into a distribution airstream provided by a blower, the blower driven by a blower motor and varying the flow rate of the distribution airstream by controlling the rotation speed of the blower motor.

Various objects and advantages of the loosefill insulation blowing machine with distribution airstream having a variable flow rate will become apparent to those skilled in the art from the following detailed description of the preferred embodiment, when read in light of the accompanying drawings.

DETAILED DESCRIPTION OF THE INVENTION

Figure 1:
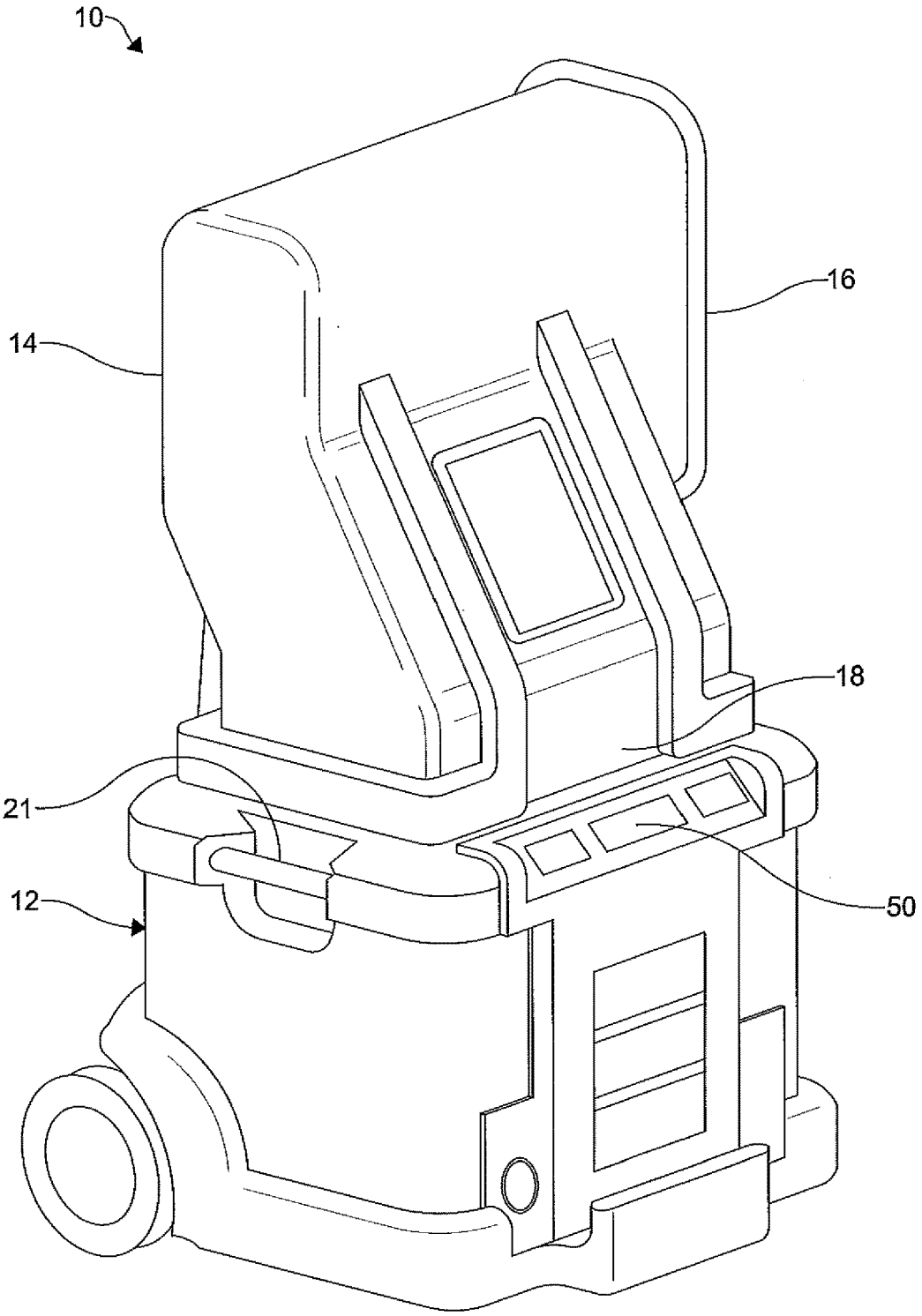
FIG. 1 is a front perspective view of a loosefill insulation material blowing machine.
Figure 2:
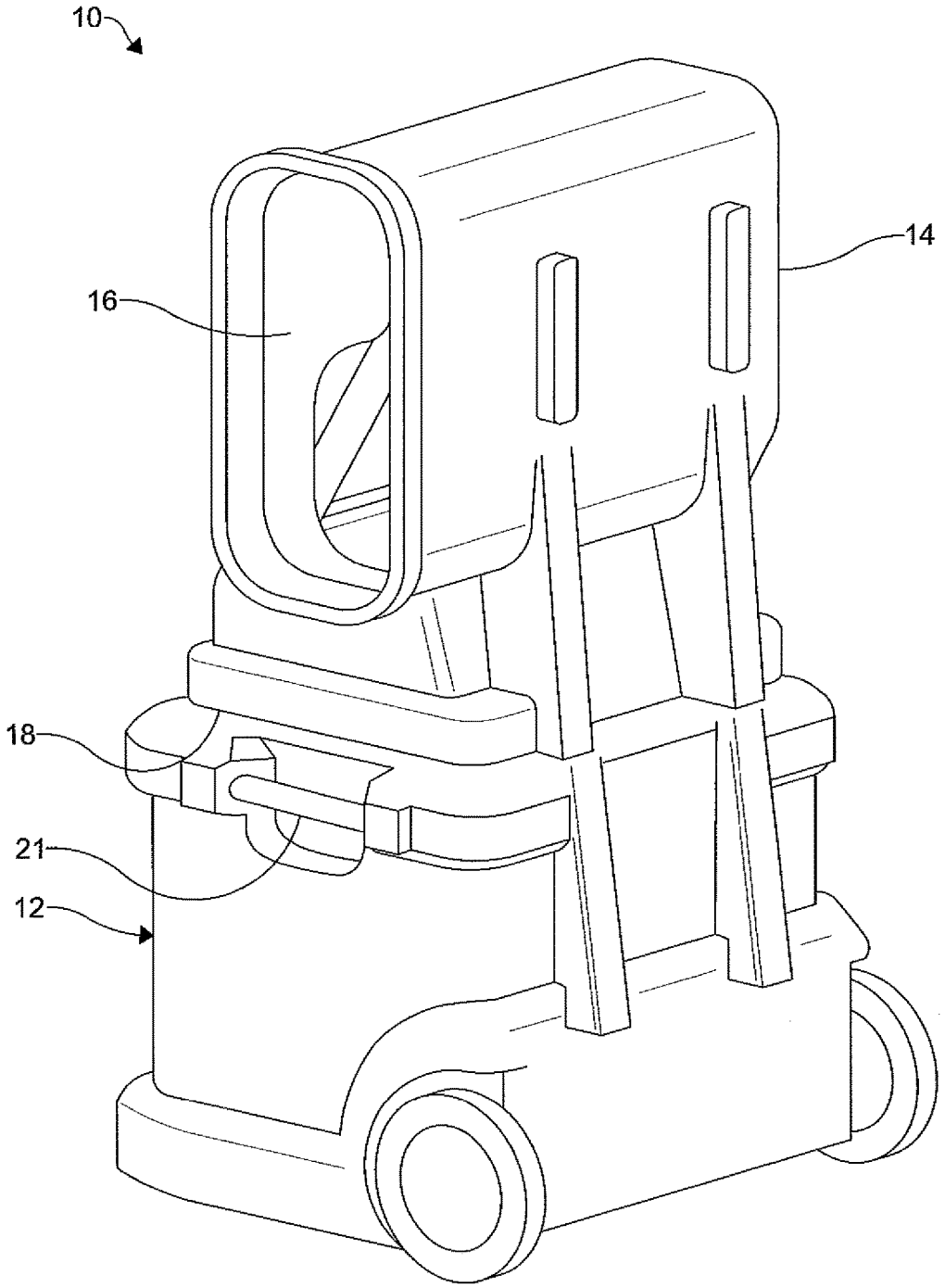
FIG. 2 is a rear perspective view of the loosefill insulation material blowing machine of FIG. 1.

The present invention will now be described with occasional reference to the specific embodiments of the invention. This invention may, however, be embodied in different forms and should not be construed as limited to the embodiments set forth herein. Rather, these embodiments are provided so that this disclosure will be thorough and complete, and will fully convey the scope of the invention to those skilled in the art.

Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. As used in the description of the invention and the appended claims, the singular forms "a," "an," and "the" are intended to include the plural forms as well, unless the context clearly indicates otherwise.

Unless otherwise indicated, all numbers expressing quantities of dimensions such as length, width, height, and so forth as used in the specification and claims are to be understood as being modified in all instances by the term "about." Accordingly, unless otherwise indicated, the numerical properties set forth in the specification and claims are approximations that may vary depending on the desired properties sought to be obtained in embodiments of the present invention. Notwithstanding that the numerical ranges and parameters setting forth the broad scope of the invention are approximations, the numerical values set forth in the specific examples are reported as precisely as possible. Any numerical values, however, inherently contain certain errors necessarily resulting from error found in their respective measurements.

In accordance with illustrated embodiments of the present invention, the description and figures disclose a loosefill insulation blowing machine with a distribution airstream having a variable flow rate. The flow rate of the air flowing within the airstream can be varied in response to differing operational parameters and conditions. As a first example, the flow rate of air flowing within the airstream can be varied in response to a blockage in the distribution hose. As another example, the flow rate of air flowing within the distribution airstream can be varied in response to comparisons of an actual Insulation Mass Flow Ratio with a theoretical Insulation Mass Flow Rate. The Insulation Mass Flow Rate is a ratio of the volume of the distribution airstream compared to the quantity of loosefill insulation material being conditioned by the blowing machine.

The term "loosefill insulation material", as used herein, is defined to mean any insulating materials configured for entrainment and distribution in a volume of air flowing within a distribution airstream. The term "finely conditioned", as used herein, is defined to mean the shredding, picking apart and conditioning of loosefill insulation material to a desired density prior to distribution into a distribution airstream. The term "airstream", as used herein, is defined to mean a current of moving air.

Referring now to FIGS. 1-4, a loosefill insulation blowing machine (hereafter "blowing machine") is shown generally at 10. The blowing machine 10 is configured for conditioning compressed loosefill insulation material and further configured for distributing the conditioned loosefill insulation material to desired locations, such as for example, insulation cavities. The blowing machine 10 includes a lower unit 12 and a chute 14. The lower unit 12 is connected to the chute 14 by one or more fastening mechanisms (not shown) configured to readily assemble and disassemble the chute 14 to the lower unit 12. The chute 14 has an inlet end 16 and an outlet end 18.

Referring again to FIGS. 1-4, the inlet end 16 of the chute 14 is configured to receive compressed loosefill insulation material. The compressed loosefill insulation material is guided within the interior of the chute 14 to the outlet end 18, wherein the loosefill insulation material is introduced to a shredding chamber 23 as shown in FIG. 3.

Referring again to FIGS. 1, 2 and 4, optionally the lower unit 12 can include one or more handle segments 21, configured to facilitate ready movement of the blowing machine 10 from one location to another. However, it should be understood that the one or more handle segments 21 are not necessary to the operation of the blowing machine 10.

Referring again to FIGS. 2 and 4, the chute 14 can include an optional bail guide (not shown for purposes of clarity) mounted at the inlet end 16 of the chute 14. The bail guide is configured to urge a package of compressed loosefill insulation material against an optional cutting mechanism (also not shown for purposes of clarity) as the package of compressed loosefill insulation material moves further into the chute 14. The bail guide and the cutting mechanism can have any desired structure and operation.

Figure 3:
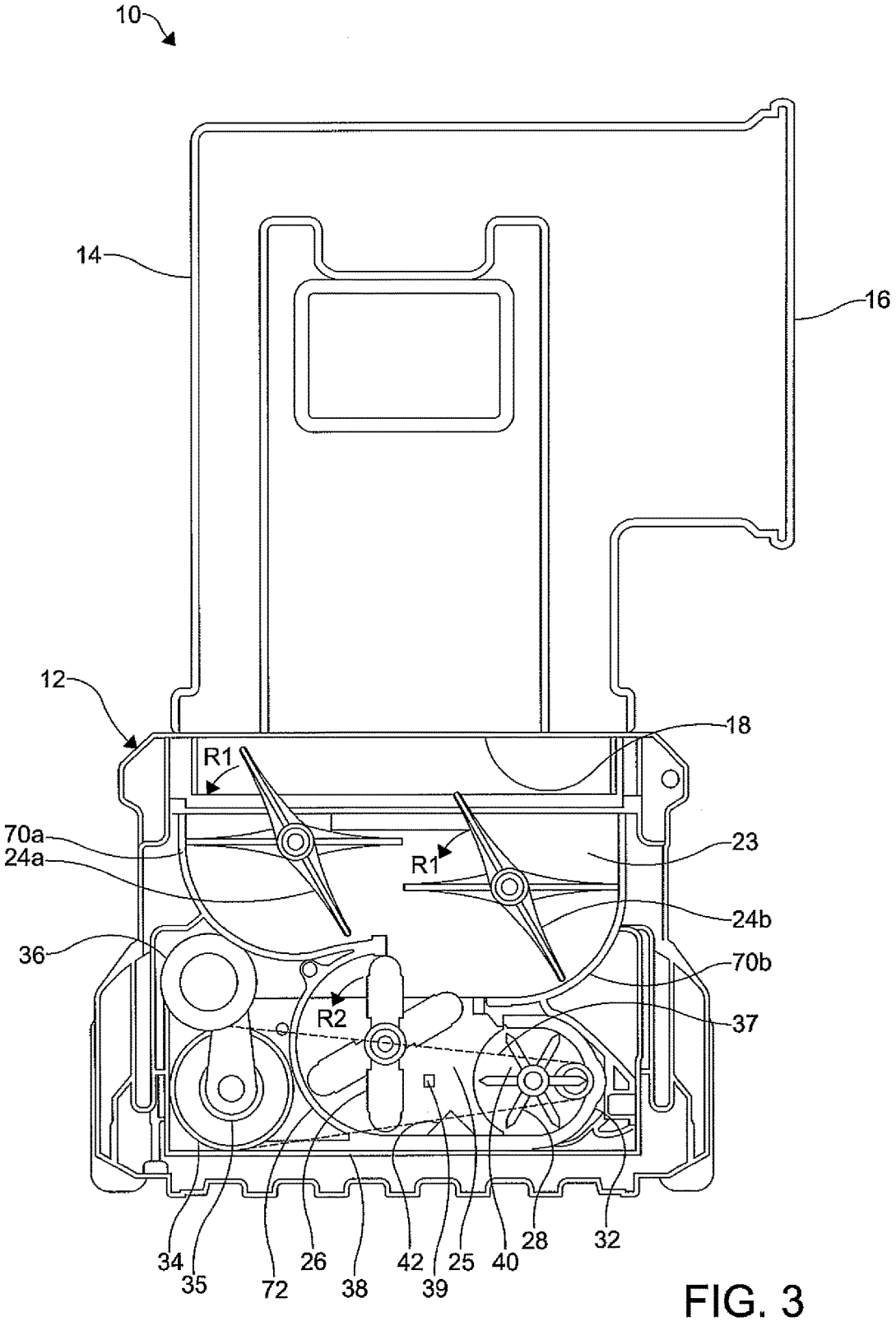
FIG. 3 is a front elevational view, partially in cross-section, of the loosefill insulation material blowing machine of FIG. 1.

Referring now to FIG. 3, the shredding chamber 23 is mounted at the outlet end 18 of the chute 14. The shredding chamber 23 includes first and second low speed shredders 24*a*, 24*b* and one or more agitators 26. The first and second low speed shredders 24*a*, 24*b* are configured to shred, pick apart and condition the loosefill insulation material as the loosefill insulation material is discharged into the shredding chamber 23 from the outlet end 18 of the chute 14. The agitator 26 is configured to finely condition the loosefill insulation material to a desired density as the loosefill insulation material exits the first and second low speed shredders 24*a*, 24*b*. It should be appreciated that although a quantity of two low speed shredders 24*a*, 24*b* and a lone agitator 26 are illustrated, any desired quantity of low speed shredders 24*a*, 24*b* and agitators 26 can be used. Further, although the blowing machine 10 is shown with first and second low speed shredders 24*a*, 24*b*, any type of separator, such as a clump breaker, beater bar or any other mechanism, device or structure that shreds, picks apart and conditions the loosefill insulation material can be used.

Referring again to FIG. 3, the first and second low speed shredders 24*a*, 24*b* rotate in a counter-clockwise direction R1 and the agitator 26 rotates in a counter-clockwise direction R2. Rotating the low speed shredders 24*a*, 24*b* and the agitator 26 in the same counter-clockwise direction allows the low speed shredders 24*a*, 24*b* and the agitator 26 to shred and pick apart the loosefill insulation material while substantially preventing an accumulation of unshredded or partially shredded loosefill insulation material in the shredding chamber 23. However, in other embodiments, each of the low speed shredders 24*a*, 24*b* and the agitator 26 could rotate in a clockwise direction or the low speed shredders 24*a*, 24*b* and the agitator 26 could rotate in different directions provided substantial accumulation of unshredded or partially shredded loosefill insulation material is avoided in the shredding chamber 23.

Referring again to FIG. 3, the agitator 26 is configured to finely condition the loosefill insulation material, thereby forming finely conditioned loosefill insulation material and preparing the finely conditioned loosefill insulation material for distribution into a volume of air flowing in a distribution airstream. In the embodiment illustrated in FIG. 3, the agitator 26 is positioned vertically below the first and second low speed shredders 24*a*, 24*b*. Alternatively, the agitator 26 can be positioned in any desired location relative to the first and second low speed shredders 24*a*, 24*b*, sufficient to receive the loosefill insulation material from the first and second low speed shredders 24*a*, 24*b*, including the non-limiting example of being positioned horizontally adjacent to the first and second low speed shredders 24*a*, 24*b*. In the illustrated embodiment, the agitator 26 is a high speed shredder. Alternatively, the agitator 26 can be any type of shredder, such as a low speed shredder, clump breaker, beater bar or any other mechanism that finely conditions the loosefill insulation material and prepares the finely conditioned loosefill insulation material for distribution into a volume of air flowing in an airstream.

In the embodiment illustrated in FIG. 3, the first and second low speed shredders 24*a*, 24*b* rotate at a lower rotational speed than the rotational speed of the agitator 26. The first and second low speed shredders 24*a*, 24*b* rotate at a rotational speed of about 40-80 rpm and the agitator 26 rotates at a rotational speed of about 300-500 rpm. In other embodiments, the first and second low speed shredders 24*a*, 24*b* can rotate at rotational speeds less than or more than 40-80 rpm and the agitator 26 can rotate at rotational speeds less than or more than 300-500 rpm. In still other embodiments, the first and second low speed shredders 24*a*, 24*b* can rotate at rotational speeds different from each other.

Referring again to FIG. 3, a discharge mechanism 28 is positioned adjacent to the agitator 26 and is configured to distribute the finely conditioned loosefill insulation material exiting the agitator 26 into a volume of air flowing in a distribution airstream. The finely conditioned loosefill insulation material is driven through the discharge mechanism 28 and through a machine outlet 32 by a volume of flowing air provided by a blower 34 and an associated first ductwork 37. The first ductwork 37 extends from the blower 34 to the discharge mechanism 28. The first ductwork 37 can have any desired structure and configuration sufficient to convey a volume of flowing air from the blower 34 to the discharge mechanism 28.

Referring again to FIG. 3, the blower 34 is mounted for rotation and is driven by a blower motor 35. The volume of flowing air within the distribution airstream is indicated by an arrow 33 in FIG. 4. In other embodiments, the airstream 33 can be provided by other methods, such as by a vacuum, sufficient to provide a flow of air through the discharge mechanism 28.

Referring again to FIG. 3, the blower motor 35 is illustrated. The blower motor 35 is configured for 120 volt alternating current (A.C.) operation and is sized to require a maximum current of 11.0 amps. Further, the blower motor 35 is of a flow-through type and has a maximum rotational speed in a range of about 30,000 revolutions per minute to about 40,000 revolutions per minute. The blower motor 35 is configured for pulse width modulation control, thereby allowing for fine control and variability in the rotational speed of the blower 34. The variable rotational speed of the blower 34 will be discussed in more detail below.

Referring again to FIG. 3, a first sensor 39 is position within the interior portions of the first ductwork 37 between the blower 34 and the discharge mechanism 28. The first sensor 39 is configured to measure the pressure of the air flowing within the first ductwork 37. The first sensor 39 will be discussed in more detail below.

Referring again to FIG. 3, the first and second shredders 24*a*, 24*b*, agitator 26 and discharge mechanism 28 are mounted for rotation. They can be driven by any suitable means, such as by an electric motor 36, or other means sufficient to drive rotary equipment. Alternatively, each of the first and second shredders 24*a*, 24*b*, agitator 26 and discharge mechanism 28 can be provided with its own source of rotation.

Referring again to FIG. 1, the blowing machine 10 includes a control panel 50. The control panel 50 includes a plurality of control devices configured to direct certain operating characteristics of the blowing machine 10, including functions such as starting and stopping of the motors 35, 36. The control panel 50 is configured to compare actual operating conditions with theoretical parameters and is further configured to direct certain operating adjustments. The monitoring and adjusting of the operating conditions within the blowing machine 10 will be discussed in more detail below.

Referring again to FIG. 3, the lower unit 12 includes a first shredder guide shell 70*a*, a second shredder guide shell 70*b* and an agitator guide shell 72. The first shredder guide shell 70*a* is positioned partially around the first low speed shredder 24*a* and extends to form an arc of approximately 90°. The first shredder guide shell 70*a* is configured to allow the first low speed shredder 24*a* to seal against an inner surface of the shredder guide shell 70*a* and thereby urge loosefill insulation material in a direction toward the second low speed shredder 24*b*.

Referring again to FIG. 3, the second shredder guide shell 70*b* is positioned partially around the second low speed shredder 24*b* and extends to form an arc of approximately 90°. The second shredder guide shell 70*b* is configured to allow the second low speed shredder 24*b* to seal against an inner surface of the second shredder guide shell 70*b* and thereby urge the loosefill insulation in a direction toward the agitator 26.

In a manner similar to the shredder guide shells, 70*a*, 70*b*, the agitator guide shell 72 is positioned partially around the agitator 26 and extends to form an arc of approximate 180°. The agitator guide shell 72 is configured to allow the agitator 26 to seal against an inner surface of the agitator guide shell 72 and thereby direct the loosefill insulation in a direction toward the discharge mechanism 28.

In the embodiment illustrated in FIG. 3, the shredder guide shells 70*a*, 70*b* and the agitator guide shell 72 are formed from a polymeric material. However, in other embodiments, the shells 70*a*, 70*b* and 72 can be formed from other desired materials including the non-limiting example of aluminum.

Referring again to FIG. 3, the shredding chamber 23 includes a floor 38 positioned below the blower 34, the agitator 26 and the discharge mechanism 28. In the illustrated embodiment, the floor 38 is arranged in a substantially horizontal plane and extends substantially across the lower unit 12. In the embodiment illustrated in FIG. 3, the floor 38 is formed from a polymeric material. However, in other embodiments, the floor 38 can be formed from other desired materials including the non-limiting example of aluminum.

Referring again to FIGS. 1-4, in operation, the inlet end 16 of the chute 14 receives compressed loosefill insulation material. As the compressed loosefill insulation material expands within the chute 14, the chute 14 guides the loosefill insulation material past the outlet end 18 of the chute 14 to the shredding chamber 23. The first low speed shredder 24*a* receives the loosefill insulation material and shreds, picks apart and conditions the loosefill insulation material. The loosefill insulation material is directed by the combination of the first low speed shredder 24*a* and the first shredder guide shell 70*a* to the second low speed shredder 24*b*. The second low speed shredder 24*b* receives the loosefill insulation material and further shreds, picks apart and conditions the loosefill insulation material. The loosefill insulation material is directed by the combination of the second low speed shredder 24*b* and the second shredder guide shell 70*b* to the agitator 26.

Figure 4:
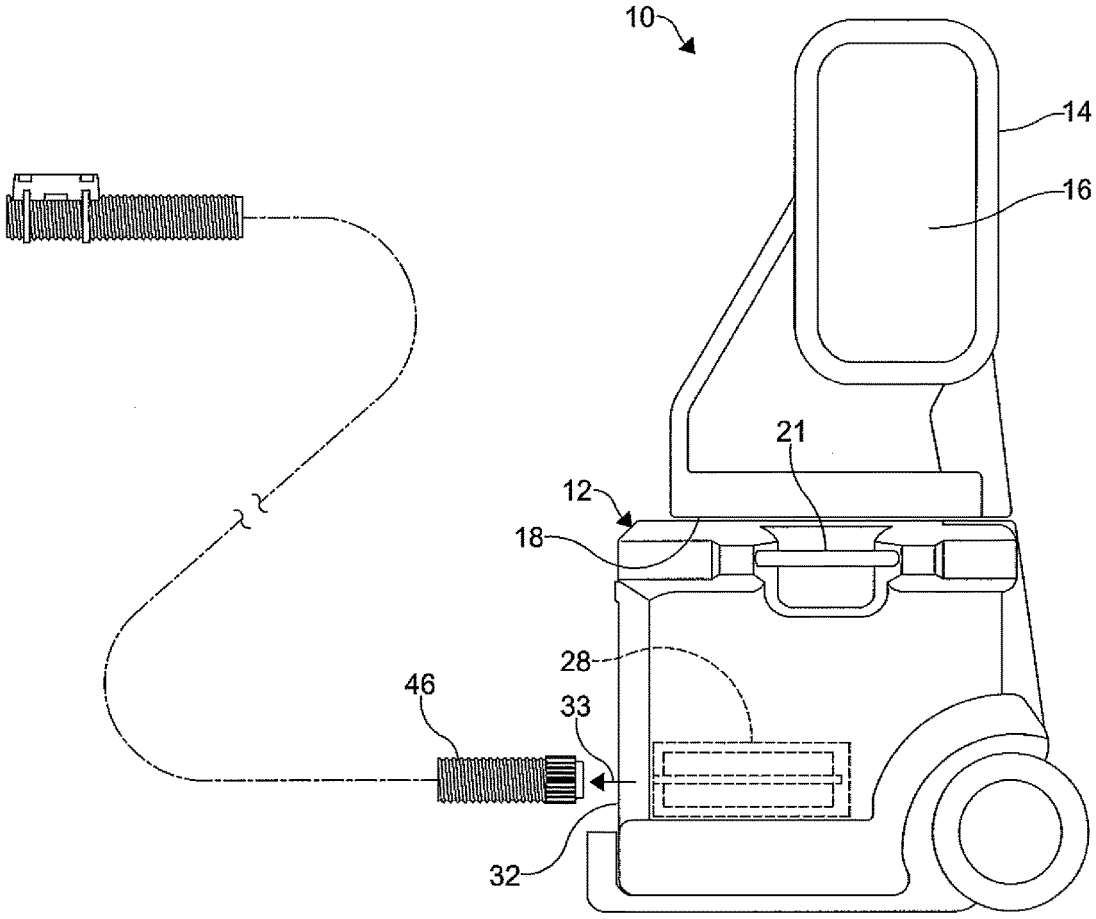
FIG. 4 is a side elevational view of the loosefill insulation material blowing machine of FIG. 1, illustrating a distribution hose.

The agitator 26 is configured to finely condition the loosefill insulation material and prepare the loosefill insulation material for distribution into the volume of air flowing in the distribution airstream 33 by finely shredding and conditioning the loosefill insulation material. The finely conditioned loosefill insulation material, guided by the agitator guide shell 72, exits the agitator 26 at the outlet end 25 of the shredding chamber 23 and enters the discharge mechanism 28 for distribution into the volume of air flowing in the distribution airstream 33 provided by the blower 34. The distribution airstream 33, entrained with the finely conditioned loosefill insulation material, exits the insulation blowing machine 10 at the machine outlet 32 and flows through a distribution hose 46, as shown in FIG. 4, toward an insulation cavity, not shown.

Referring again to FIG. 3, the discharge mechanism 28 has a side inlet 40 and an optional choke 42. The side inlet 40 is configured to receive the finely conditioned blowing insulation material as it is fed from the agitator 26. In the illustrated embodiment, the agitator 26 is positioned adjacent to the side inlet 40 of the discharge mechanism 28. In other embodiments, the low speed shredders 24*a*, 24*b* or agitator 26, or other shredding mechanisms can be positioned adjacent to the side inlet 40 of the discharge mechanism 28 or in other suitable positions.

Referring again to FIG. 3, the optional choke 42 is configured to partially obstruct the side inlet 40 of the discharge mechanism 28 such that heavier clumps of blowing insulation material are prevented from entering the side inlet 40 of the discharge mechanism 28. The heavier clumps of blowing insulation material are redirected past the side inlet 40 of the discharge mechanism 28 to the shredders 24*a*, 24*b* for recycling and further conditioning.

Figure 5:
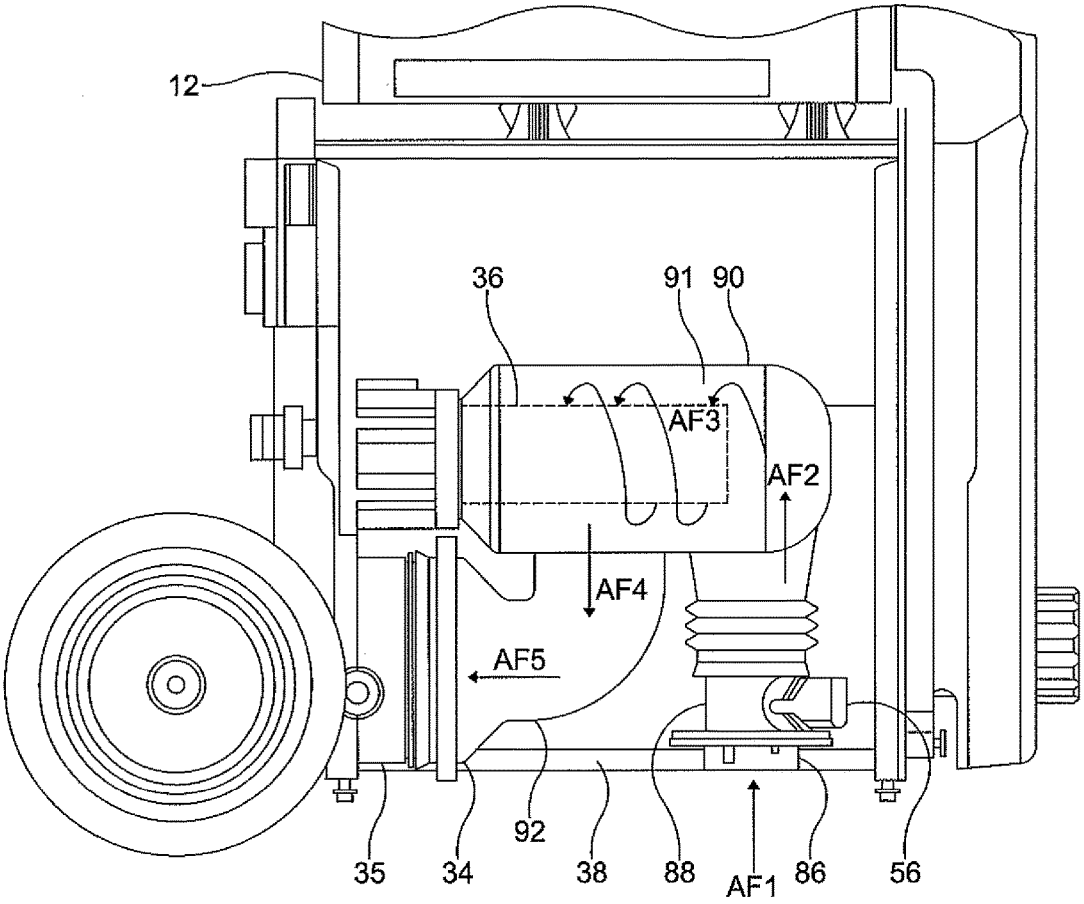
FIG. 5 is an enlarged side view of the lower unit of FIG. 3 showing a second sensor.

Referring now to FIG. 5, a side view of a portion of the lower unit 12 is illustrated. The blower 34 and the blower motor 35 are positioned adjacent the floor 38. The motor 36 configured to drive certain rotary components is positioned vertically above the blower 34. A port 86 extends through the floor 38 and is configured as an inlet for a volume of flowing air as shown by direction arrow AF1. The port 86 is fluidly connected to a second ductwork 88 configured as a conduit for the airflow AF1. The second ductwork 88 is fluidly connected to a motor enclosure 90. The motor enclosure 90 is configured to enclose the motor 36. A cavity 91 is formed in a circumferential space between an exterior surface of the motor 36 and an interior circumferential surface 93 of the motor enclosure 90. In the illustrated embodiment, the enclosure 90 has a cylindrical shape. However, the enclosure 90 can have other shapes sufficient to enclose the motor 36 while forming a cavity between an exterior surface of the motor 36 and the interior circumferential surface 93 of the motor enclosure 90. The cavity 91 within the motor enclosure 90 is configured to receive the airflow as indicated by direction arrow AF2.

Referring again to FIG. 5, cavity 91 within the motor enclosure 90 is fluidly connected to a third ductwork 92 extending from the motor enclosure 90 to the blower 34. The third ductwork 92 is configured as a conduit for an airflow, indicated by direction arrow AF4, and can have any desired structure.

In operation, the blower 34 develops a volume of flowing air through the lower unit 12 as described in the following steps. In an initial step, operation of the blower 34 creates a vacuum that extends through the third ductwork 92, the cavity 91 within the enclosure 90 and through the second ductwork 88 to the port 86. The vacuum creates the airflow AF1. The airflow AF1 flows into the port 86, through the second ductwork 88 and into the cavity 91 within the enclosure 90 as indicated by direction arrow AF2. Once in the enclosure 90, the airflow encircles the motor 36, as indicated by direction arrows AF3. The airflow encircles the motor 36 and finally flows through into the third ductwork 92 as indicated by arrow AF4. The airflow continues flowing into the blower 34 as shown by arrow AF5.

Referring again to FIG. 5, a second sensor 56 is positioned adjacent the second ductwork 88. In this position, the second sensor 56 is in fluid communication with the flow of air within the second ductwork 88. The second sensor 56 is configured to measure the flow of air flowing within the second ductwork 88. The second sensor 56 will be discussed in more detail below.

As discussed above, the blowing machine 10 can vary the rate of air flowing within the distribution airstream 33 based on differing operational conditions. Referring now to FIGS. 3 and 4, a first non-limiting example of a variable distribution air flow rate will be discussed. The finely conditioned loosefill insulation material provided by the agitator 26 is driven through the discharge mechanism 28, through a machine outlet 32 and into the distribution hose 46 by a volume of flowing distribution air provided by a blower 34 and conveyed by the associated first ductwork 37. The first sensor 39, positioned in the first ductwork 37, is configured to measure the pressure of the distribution air flowing within the first ductwork 37.

In the event of a blockage within the distribution hose 46 that hinders or impedes the flow of the distribution airstream 33, the pressure of the flowing air within the first ductwork 37 begins to rise. The increased air pressure is sensed by the first sensor 39. The first sensor 39 generates a signal indicating a rise in the air pressure within the first ductwork 37 and communicates the generated signal to the control panel 50. Upon receiving the signal from the first sensor 39 indicating the increased air pressure, the control panel 50 directs the blower motor 35 to briefly increase its rotation speed, thereby increasing or "pulsing" the air flow rate of the distribution airstream 33. The increase in the air flow rate of the distribution airstream 33 is intended to clear the blockage within the distribution hose 46.

In the event the blockage in the distribution hose 46 is cleared, the first sensor 39 detects the decrease of the air pressure within the first ductwork 37. The first sensor 39 generates a signal indicating a decrease of the air pressure within the first ductwork 37 and communicates the generated signal to the control panel 50. Upon receiving the signal from the first sensor 39, the control panel 50 directs the blower motor 35 to return to a normal rotational speed, thereby returning the air flow rate of the distribution airstream 33 back to the pre-blockage level.

In the event the blockage is not cleared after increasing the rotational speed of the blower motor 35, the first sensor 39 continues to register an increased air pressure within the first ductwork 37 and continues to communicate signals to the control panel 50 indicating the increased air pressure. After a predetermined duration, the control panel 50 directs the blower motor 35 to stop, thereby preventing overheating or other damage to the blower motor 35. In the illustrated embodiment, the predetermined duration for the blower motor 35 to have an increased rotational speed is in a range of from about 300 milliseconds to about 500 milliseconds. However, in other embodiments, the predetermined duration for the blower motor 35 to have an increased rotational speed can be less than about 300 milliseconds or more than 500 milliseconds. After clearing the blockage in the distribution hose 46 by other means, such as for example manually, the blowing machine 10 can be operated at pre-blockage levels.

Referring now to FIGS. 3 and 5, a second non-limiting example of a variable distribution air flow rate will be discussed. As discussed above, the finely conditioned loosefill insulation material provided by the agitator 26 is entrained in a distribution airstream 33 in the discharge mechanism 28. The entrained distribution airstream 33 is driven through the discharge mechanism 28, through a machine outlet 32 and into the distribution hose 46 by a volume of flowing distribution air provided by a blower 34.

Referring again to FIGS. 3 and 5, the variable distribution air flow rate can be incorporated by the blowing machine 10 in different operating modes. A first example of an operating mode is a "full-on mode". The term "full-on mode", as used herein, is defined to mean the blower 34 is configured to provide a distribution airstream 33 with a high volume and a high velocity. The high volume and high velocity of the distribution airstream 33 results in the blown loosefill insulation material having a low density when installed in an insulation cavity. The full-on mode can result in an installed density of the blown loosefill insulation material in a range of from about 0.40 pounds per cubic foot to about 0.60 pounds per cubic foot. The full-on mode is configured for effectively insulating typical open insulation cavities, such as for example, an attic expanse.

A second example of an operating mode is a "dense mode". The term "dense mode", as used herein, is defined to mean the blower motor 35 operates at a lower rotational speed that at the full-on mode. Accordingly, the blower 34 provides a distribution airstream 33 having less volume and a slower velocity. Since the distribution airstream 33 has less volume and a slower velocity, the resulting density of the blown loosefill insulation material is higher than that achieved when the blower 34 is operating at the full-on mode. As one non-limiting example, in the dense mode the blower 34 can operate at 40.0% of the rotational speed of the full-on mode. The resulting density of the blown loosefill insulation material is then in a range of from about 0.60 pounds per cubic foot to about 1.00 pounds per cubic foot. The increased density of the blown loosefill insulation material can be advantageously used for insulating difficult to reach areas, such as for example eaves and around obstructions. Since the density of the blown loosefill insulation material is higher around the difficult to reach areas, the resulting insulative value (R-value) of the blown loosefill insulation material in these areas is correspondingly higher.

A third example of an operating mode is a "wall mode". The term "wall mode", as used herein, is defined to mean the blower 34 is configured to provide a distribution airstream 33 with the volume and velocity sufficient to fill an insulation cavity within the confinement of a wall structure, typically through a small inlet opening. The wall cavity is typically formed between framing members and between external sheathing and internal wall panels. A different wall modes are possible, the volumes and velocities of the various wall mode distribution airstreams 33 result in the blown loosefill insulation material having an installed density in a range of from about 0.50 pounds per cubic foot to about 2.50 pounds per cubic foot.

Various blowing machine operating parameters can be established for the various operating modes. One non-limiting example of a blowing machine operating parameter is an "Insulation Mass Flow Rate". The term Insulation Mass Flow Rate, as used herein, is defined as the ratio of the air flow of the distribution airstream 33 (in cubic feet per minute) to the flow of conditioned loosefill insulation material through the discharge mechanism 28 (in pounds per minute).

As discussed above, the second sensor 56 is configured to measure the flow of air flowing within the second ductwork 88, which subsequently becomes the distribution airstream 33. In the illustrated embodiment, the second sensor 56 converts the level of the flow of air into a second sensor 56 voltage. It should be appreciated that in other embodiments, other types of signals, such as the non-limiting example of an electrical current, can be used to indicate the level of the flow of air measured by the second sensor 56.

Referring again to 3, the flow rate of the conditioned loosefill insulation material is determined by the rotation speed of the agitator 26.

For the various operating modes, a theoretical Insulation Mass Flow Rate can be determined from theoretical airflows and theoretical agitator rotational speeds as shown in Table 1.

TABLE 1

| Mode | Theoretical Insulation Mass Flow Rate (lbs. per min.) | Theoretical Rate of Air Flow ($ft^3$ per min.) | Theoretical Rotational Agitator Speed (rpm) |
|---|---|---|---|
| Full-On | 8.0 | 107.0 | 345.0 |
| Dense | 6.0 | 23.0 | 345.0 |
| Wall (Density 1) | 2.5-3.2 | 29.0 | 90.0 |
| Wall (Density 2) | 3.0 | 47.0 | 90.0 |
| Wall (Density 3) | 2.9-4.4 | 74.0 | 120.0 |

As shown in Table 1, a combination of an air flow rate of 107.0 $ft^3$ per minute through the discharge mechanism 28 and a rotational agitator speed of 345.0 revolutions per minute provide a theoretical Insulation Mass Flow Rate of 8.0 for the full-on mode. As also shown in Table 1, a combination of an air flow rate of 23.0 $ft^3$ per minute through the discharge mechanism 28 and a rotational agitator speed of 345.0 revolutions per minute provide a theoretical Insulation Mass Flow Rate of 6.0 for the dense mode. As also shown in Table 1, a combination of an air flow rate of 29.0 $ft^3$ per minute through the discharge mechanism 28 and a rotational agitator speed of 90.0 revolutions per minute provide a theoretical Insulation Mass Flow Rate of 2.5-3.2 for the first wall mode, providing a blown density of 1.3 lbs./$ft^3$. As further shown in Table 1, a combination of an air flow rate of 47.0 $ft^3$ per minute through the discharge mechanism 28 and a rotational agitator speed of 90.0 revolutions per minute provide a theoretical Insulation Mass Flow Rate of 2.7 for the second wall mode, providing a blown density of 1.5 lbs./$ft^3$. Finally, as shown in Table 1, a combination of an air flow rate of 74.0 $ft^3$ per minute through the discharge mechanism 28 and a rotational agitator speed of 120.0 revolutions per minute provide a theoretical Insulation Mass Flow Rate of 2.9-4.4 for the third wall mode, providing a blown density of 1.8 lbs./$ft^3$.

In operation, theoretical values of the Insulation Mass Flow Rate for each of the operating modes are stored in the control panel 50. As the blowing machine is operated in a selected mode, the actual rate of airflow is determined by the second sensor 56 and the actual Insulation Mass Flow Rate is determined using the rotational speed of the agitator 26. The control panel 50 compares the actual Insulation Mass Flow Rate to the theoretical Insulation Mass Flow Rate for the selected mode. In the event the theoretical and actual Insulation Mass Flow Rates differ, the control panel 50 directs the blower motor 35 to increase or decrease its rotation speed until such point that the theoretical and actual Insulation Mass Flow Rates agree. In this manner, the desired density of the blown loosefill insulation material can be ensured for a given blowing machine operating mode.

Advantageously, by adjusting the rotational speed of the blower motor 35 until the theoretical and actual Insulation Mass Flow Rates agree, the blowing machine 10 can easily achieve prescribed densities, coverages and thermal insulative valves (R-values) for the given operating modes.

While the embodiment of the blowing machine 10 shown in FIG. 3 provides for the first sensor 39 to be positioned within the interior portions of the first ductwork 37 between the blower 34 and the discharge mechanism 28, it should be appreciated that the first sensor 39 can be positioned in other desired locations sufficient to measure the pressure of the air flowing within the first ductwork 37. Similarly, while the embodiment of the blowing machine 10 shown in FIG. 5 provides for the second sensor 56 to be positioned adjacent the second ductwork 88, it should be appreciated that the second sensor 56 can be positioned in other desired locations sufficient to measure the flow of air flowing within the second ductwork 88, cavity 91 or third ductwork 92.

The principle and mode of operation of the loosefill insulation blowing machine with a distribution airstream having a variable flow rate have been described in certain embodiments. However, it should be noted that the loosefill insulation blowing machine with a distribution airstream having a variable flow rate may be practiced otherwise than as specifically illustrated and described without departing from its scope.

What is claimed is:

1. A machine for distributing loosefill insulation material from a package of compressed loosefill insulation material, the machine comprising:

a chute having an inlet end and an outlet end, the inlet end configured to receive compressed loosefill insulation material;

a lower unit having:

a shredding chamber configured to receive the compressed loosefill insulation material from the outlet end of the chute, the shredding chamber including a plurality of shredders and at least one agitator configured to shred, pick apart and condition the loosefill insulation material thereby forming conditioned loosefill insulation material, the at least one agitator having an actual rotational speed;

a discharge mechanism mounted to receive the conditioned loosefill insulation material exiting the shredding chamber, the discharge mechanism configured to distribute the conditioned loosefill insulation material into a distribution airstream;

a blower configured to provide the distribution airstream flowing through the discharge mechanism, the blower driven by a blower motor;

an airflow sensor positioned upstream from the blower motor and configured to measure an actual airflow into the blower motor;

a control panel configured to direct operating characteristics of the machine and further configured to compare an actual insulation mass flow rate using the measured actual airflow and the actual rotational speed of the agitator to a theoretical insulation mass flow rate for a selected mode;

wherein a flow rate of the distribution airstream is varied by control of the rotational speed of the blower motor as directed by the control panel thereby varying the density, coverage and thermal insulative value of the distributed loosefill insulation material until such point that the theoretical insulation mass flow rate and the actual insulation mass flow rate agree.

2. The machine of claim 1, wherein the blower motor is configured for pulse width modulation control.

3. The machine of claim 1, wherein the blower motor is configured for 120 volt alternating current and is sized to require a maximum of 11.0 amps.

4. The machine of claim 3, wherein the blower motor is of a flow-through design that has a maximum rotation speed in a range of from 30,000 revolutions per minute to 40,000 revolutions per minute.

5. The machine of claim 1, wherein the rotational speed of the blower motor is increased in response to a blockage in a distribution hose.

6. The machine of claim 5, wherein the increase in the rotational speed of the blower motor occurs for a duration in a range of from 300 milliseconds to 500 milliseconds.

7. The machine of claim 5, wherein the blockage in the distribution hose results in an increased pressure within the machine, and wherein the increased pressure is sensed by a pressure sensor.

8. The machine of claim 7, wherein the pressure sensor is positioned in ductwork extending from the blower to the discharge mechanism.

9. The machine of claim 1, wherein the theoretical Insulation Mass Flow Rate is stored in the control panel.

10. The machine of claim 1, wherein an actual flow rate of the distribution airstream is measured at a port positioned upstream from the blower.

11. The machine of claim 10, wherein the port is positioned in a floor of the machine.

12. The machine of claim 1, wherein the machine has various operating modes including a full-on mode, a dense mode and one or more wall modes.

13. A method of operating a machine for distributing loosefill insulation material from a package of compressed loosefill insulation material, the method comprising the steps of:

loading compressed loosefill insulation material into a chute;

guiding the compressed loosefill insulation material from the chute into a lower unit, the lower unit having a shredding chamber, the shredding chamber including a plurality of shredders and at least one agitator configured to shred, pick apart and condition the loosefill insulation material, the at least one agitator having an actual rotational speed, the plurality of shredders driven by one or more motors, the lower unit also having a discharge mechanism mounted to receive the conditioned loosefill insulation material exiting the shredding chamber, the discharge mechanism configured to distribute the conditioned loosefill insulation material into a distribution airstream provided by a blower, the blower driven by a blower motor, a sensor positioned upstream from the blower motor and configured to measure an actual airflow into the blower motor and a control panel configured to direct operating characteristics of the machine and further configured to compare an actual insulation mass flow rate using the measured actual airflow and the actual rotational speed of the agitator to a theoretical insulation mass flow rate for a selected mode; and varying the flow rate of the distribution airstream by controlling the rotation speed of the blower motor until such point that the theoretical insulation mass flow rate and the actual insulation mass flow rate agree.

14. The method of claim 13, including the step of controlling the rotation speed of the blower motor with pulse width modulation.

15. The method of claim 13, including the step of measuring an air flow entering the blower.

16. The method of claim 13, including the step of controlling the rotation speed of the blower motor following the comparison of the actual Insulation Mass Flow Rate with a theoretical Insulation Mass Flow Rate.

* * * * *